US006517396B1

(12) United States Patent
Into

(10) Patent No.: US 6,517,396 B1
(45) Date of Patent: Feb. 11, 2003

(54) BOAT SPEED CONTROL

(76) Inventor: Stephen W. Into, 10 Ann Lee Rd., Harvard, MA (US) 01451

( * ) Notice: Subject to any disclaimer, the term of this patent is extended or adjusted under 35 U.S.C. 154(b) by 0 days.

(21) Appl. No.: 09/609,515

(22) Filed: Jul. 3, 2000

(51) Int. Cl.[7] ..... B60K 41/00
(52) U.S. Cl. ..... 440/84; 440/87
(58) Field of Search ..... 440/87, 1, 84; 123/339, 350, 349, 361

(56) References Cited

U.S. PATENT DOCUMENTS 6,102,755 A * 8/2000 Hoshiba ..... 440/1

* cited by examiner

*Primary Examiner*—Ed Swinehart

(74) *Attorney, Agent, or Firm*—Fish & Richardson P.C.

(57) ABSTRACT

A control system for controlling the speed of a boat of the type including a motor having a throttle control lever coupled to a throttle of the motor provides for stable and predictable control of the speed of a boat The control system includes a position detector configured to detect the position of the throttle control lever and to generate a first signal representative of a target speed of the motor; a sensor which generates a second signal representative of the actual speed of the motor; an actuator adapted to control the throttle; and a servo controller, which in response to the first signal and the second signal, generates an output to adjust the position of the actuator.

3 Claims, 6 Drawing Sheets

BOAT SPEED CONTROL

BACKGROUND

This invention relates to a system for controlling the speed of a boat.

Motorboats typically include a throttle lever positioned in the cockpit and connected via a push-pull cable to the throttle of the motor. The word "throttle" is intended to mean any device that controls the output of a motor. For example, in carbureted vehicles, the throttle controls the fuel and air intake into the motor; while in some fuel-injected vehicles, the throttle controls air intake.

Referring to FIG. 1, a boat 1A includes a motor 5A mounted to the stem of the boat and a throttle 7A for regulating the speed of the motor. Within the cockpit area of boat 1A is a throttle lever 10A, which is connected to throttle 7A via a push-pull cable 12A (e.g., Bowden cable). A shift mechanism connected to the boat's transmission is generally incorporated within the throttle lever 10A as well. The position of the lever, therefore, is used to regulate the speed and usually the direction (i.e., forward or reverse) of the motor. In particular, to control the boat's speed, the operator sets the lever at a predetermined position to drive the boat at a constant speed. To drive the boat in the forward direction, the operator pushes the lever forward from a center position; and to drive the boat in the reverse direction, the operator pulls the lever back from the center position.

Manually positioning the throttle lever 10A, however, does not ensure that the speed of the boat is constant. A number of other factors influence the actual speed of the boat including changing water conditions, e.g., from waves and from the boat "coming on or off plane." In other words, while the motor provides a constant power output for a predetermined hand lever position under stable conditions, the speed of the boat in actual conditions varies because the moving boat is experiencing other forces. Thus, to maintain a uniform speed, the operator is generally required to repeatedly adjust the position of the throttle lever.

SUMMARY OF THE INVENTION

The invention features a control system for controlling the speed of a boat of the type including a motor and throttle control lever.

In one aspect of the invention, the control system includes a position detector configured to detect the position of the throttle control lever and to generate a first signal representative of a target speed of the motor; a sensor which generates a second signal representative of the actual speed of the motor; an actuator adapted to control the throttle; and a servo controller, which in response to the first signal and the second signal, generates an output to adjust the position of the actuator.

Embodiments of this aspect of the invention may include one or more of the following features. The position detector and the throttle control lever are remotely located from the actuator. The positions of the input device are representative of a target speed of a motor of the boat. Alternatively, the positions of the input device are representative of a target speed of the boat. The control system further includes a manual override mechanism concentrically mounted and releasably coupled to the control system. A pin is provided for releasably coupling the manual override mechanism to the control system. A pin is provided for releasably coupling the manual override mechanism to the control system.

{SWI—this paragraph talks about releasable shifting—not my invention, and not included in the first implementation. I think this wording was intended to make the point about the original design. That design was to have a mechanical backup mechanism that allowed disabling of the actuator and enabling of the throttle lever to mechanically move the throttle in the event of a system failure In another aspect of the invention, a method of controlling the speed of a boat includes the following steps. A position of an input device is detected and a first input based on the position of the input device is generated, the first input being representative of a target speed of a motor of the boat.

In another aspect of the invention, a control system includes a first servo control loop to control the speed of the boat and a second servo control loop to control the speed of the motor. The first servo control loop has input signals and an output signal while the second servo control loop also has input signals, one of which is the output signal from the first servo control loop.

The cascaded servo loops are employed to allow precise tuning of the servo operation for different aspects of the boat response, e.g.—the throttle actuator has a dedicated servo loop to tune its performance relative to precisely actuating the throttle mechanism. Motor speed is precisely controlled with an RPM servo loop. Furthermore, in another embodiment of the invention, the control system includes a third servo loop to allow tuning of the response to the dynamics of the boat and speed detection.

The method further includes detecting an actual speed of the motor, generating a second input representative of the actual speed of the motor, and generating an output, on the basis of the first input and the second input, to minimize the difference between the first input and the second input. Among other advantages, the control system provides for stable and predictable control of the speed of a boat. With this arrangement, the control system and its method of operation allows the operator to maintain the speed of the boat or motor without having to repeatedly adjust the hand lever. The control system can be interfaced to an existing standard boat control such that little or no training is required to learn the operation of the control system since the user interface is similar to standard controls. The control system can be used at all boat speeds, including very slow speeds. The control system can also be installed on standard locations on the boat without the need for much additional hardware mounting space. The cascaded loops allow fast servo loop response to maintain steady RPM control, while the slower boat speed control loop adjusts the desired RPM. This makes it possible to have quick response and a high degree of control.

Other features and advantages of the invention will be apparent from the description of the preferred embodiment thereof, and from the claims.

DESCRIPTION OF DRAWINGS

FIG. 4B is a schematic representation of a second portion of the servo system used in conjunction with the boat speed control system of FIG. 2; and.

DETAILED DESCRIPTION

Figure 1:
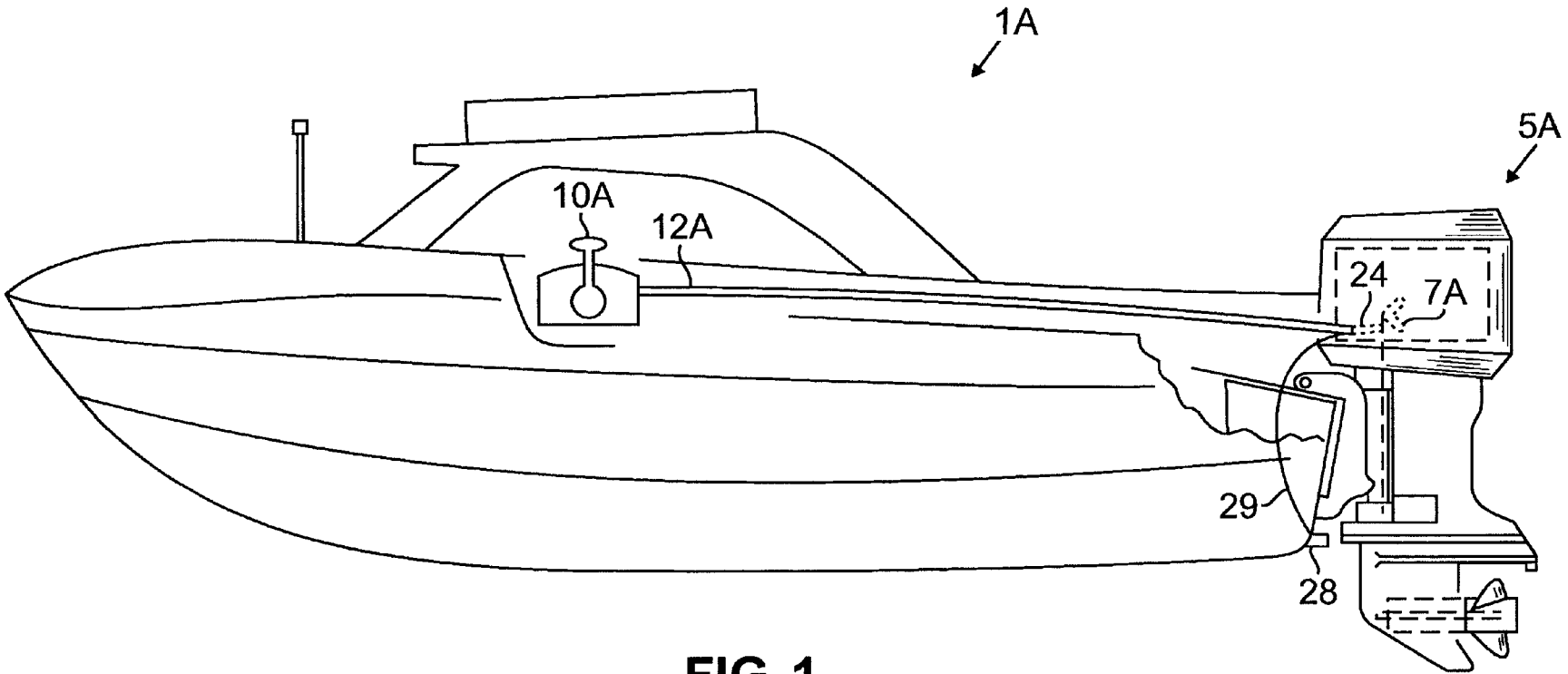
FIG. 1 is a side view of a boat having a standard throttle control system.
Figure 2:
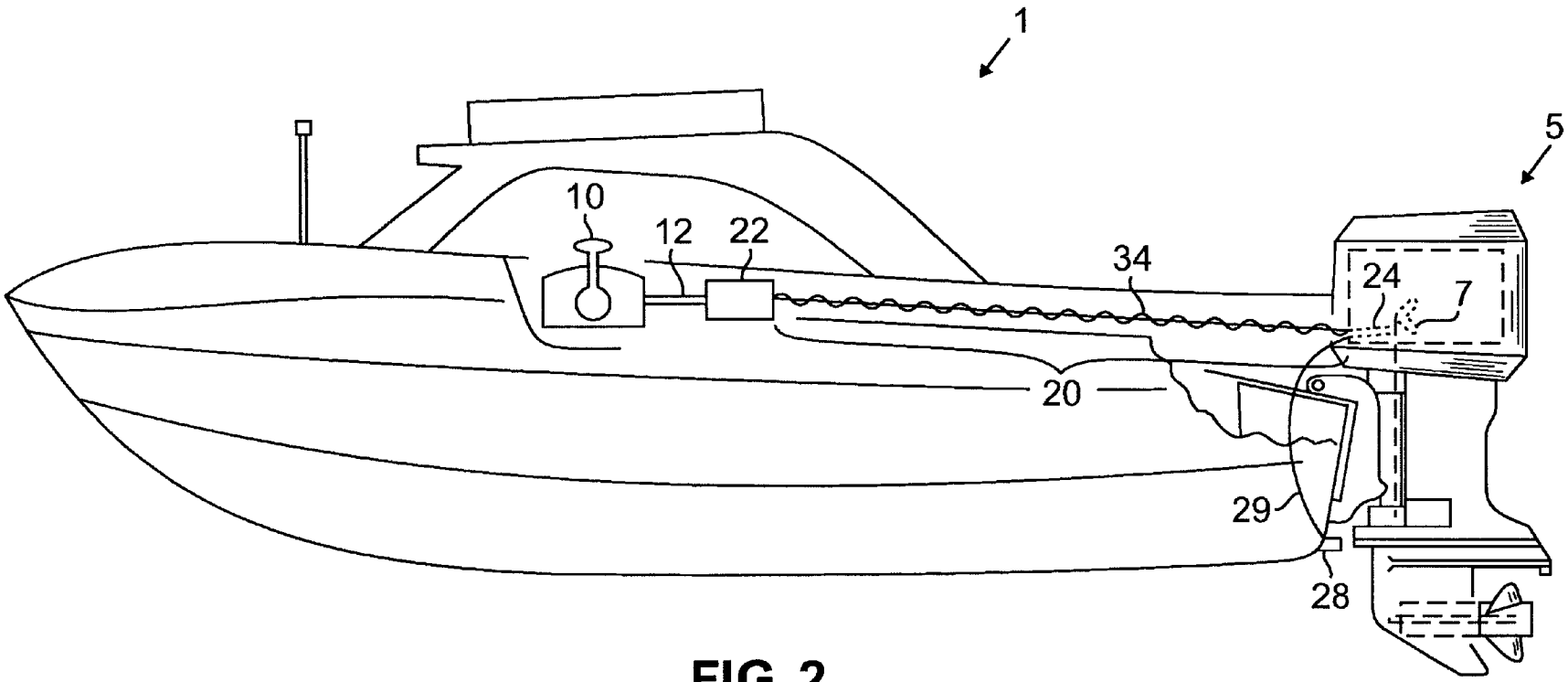
FIG. 2 is a side view of a boat having a boat speed control system of the invention.

Referring to FIG. 2, a boat 1 includes a motor 5 mounted to the stern of the boat and a throttle 7 for regulating the speed of the motor. Within the cockpit area of boat 1 is a throttle lever 10, which is connected to throttle 7 through speed control system 20.

As will be described in greater detail below, speed control system 20 provides for improved operator control of the speed of boat 1 without having to repeatedly adjust throttle lever 10. In this embodiment, speed control system 20 is shown having a first housing 22 positioned adjacent to throttle lever 10 and having a position sensor 30 (FIG. 3) electrically connected, via wiring 34, to a controller 32 (FIG. 3) mounted within a second housing 24 mounted near throttle 7. In a particular embodiment, boat 1 also includes a Pitot tube 28 mounted at a rear end of the boat's hull. As is known in the art, a Pitot tube measures the pressure of flowing fluid where it is inserted and hence, indirectly, can provide an indication of the actual speed of the boat. Pitot tube 28 is connected to a pressure sensor via tubing (neither shown). The pressure sensor is connected via electrical wires 29 to controller 32 of speed control system 20.

Figure 3:
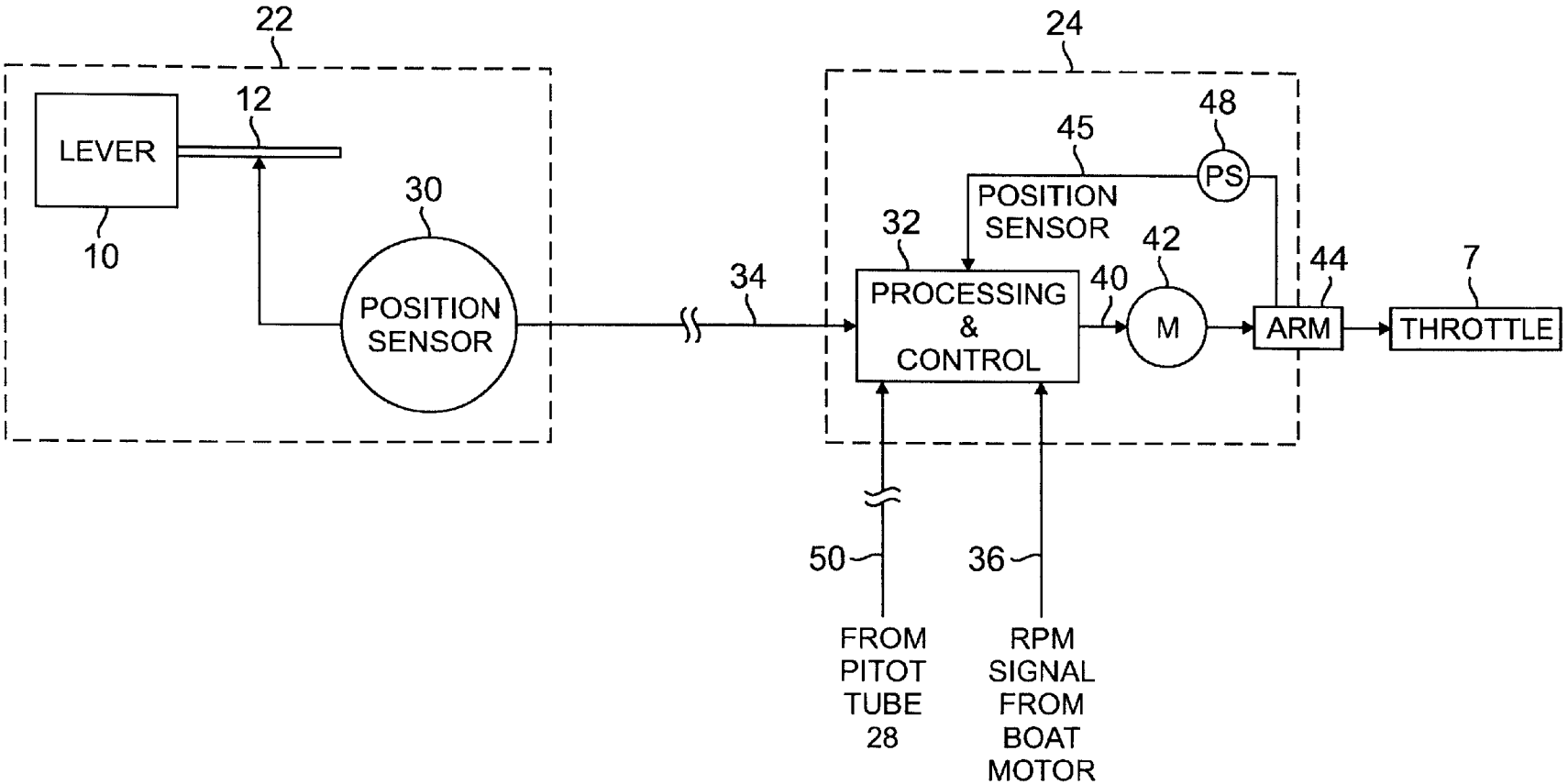
FIG. 3 is a block diagram of the boat speed control system of FIG. 2.

Referring to FIG. 3, controller 32 receives a first electrical signal from a position sensor 30 via wiring 34 and a second electrical signal representative from position sensor 48 at an output arm 44 via wiring 45. Controller 32 operates as part of a servomechanism to generate an output signal 40 for driving an actuator, here an electrical motor 42 connected to output arm 44. In response to output signal 40, electrical motor 42 moves output arm 44 to apply or release a force on throttle 7 of boat motor 5, thereby providing improved control of the speed of the boat motor. Position sensor 30 (e.g., potentiometer or position encoder) detects the change in position of throttle lever, in this embodiment indirectly, by measuring the change in position of cable 12 coupled to throttle lever 10. Position sensor 30 generates a first electrical signal 34, which can be representative of a number of different, but related characteristics of the boat. For example, the position of lever 10 may represent the position of output arm 44, the speed of motor 5, or the desired speed of the boat.

Figure 4A:
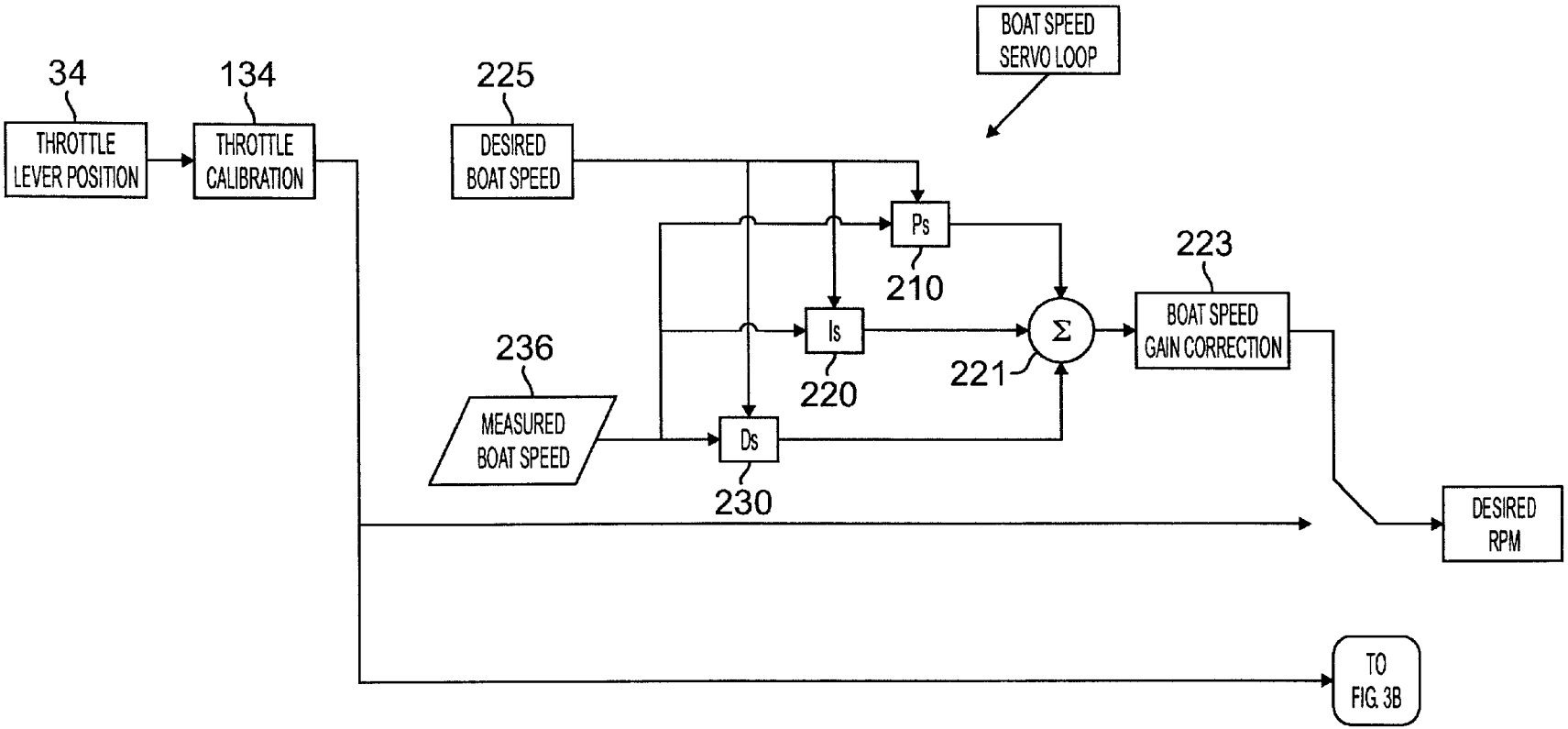
FIG. 4A is a schematic representation of a first portion of a servo system used in conjunction with the boat speed control system of FIG. 2.
Figure 4B:
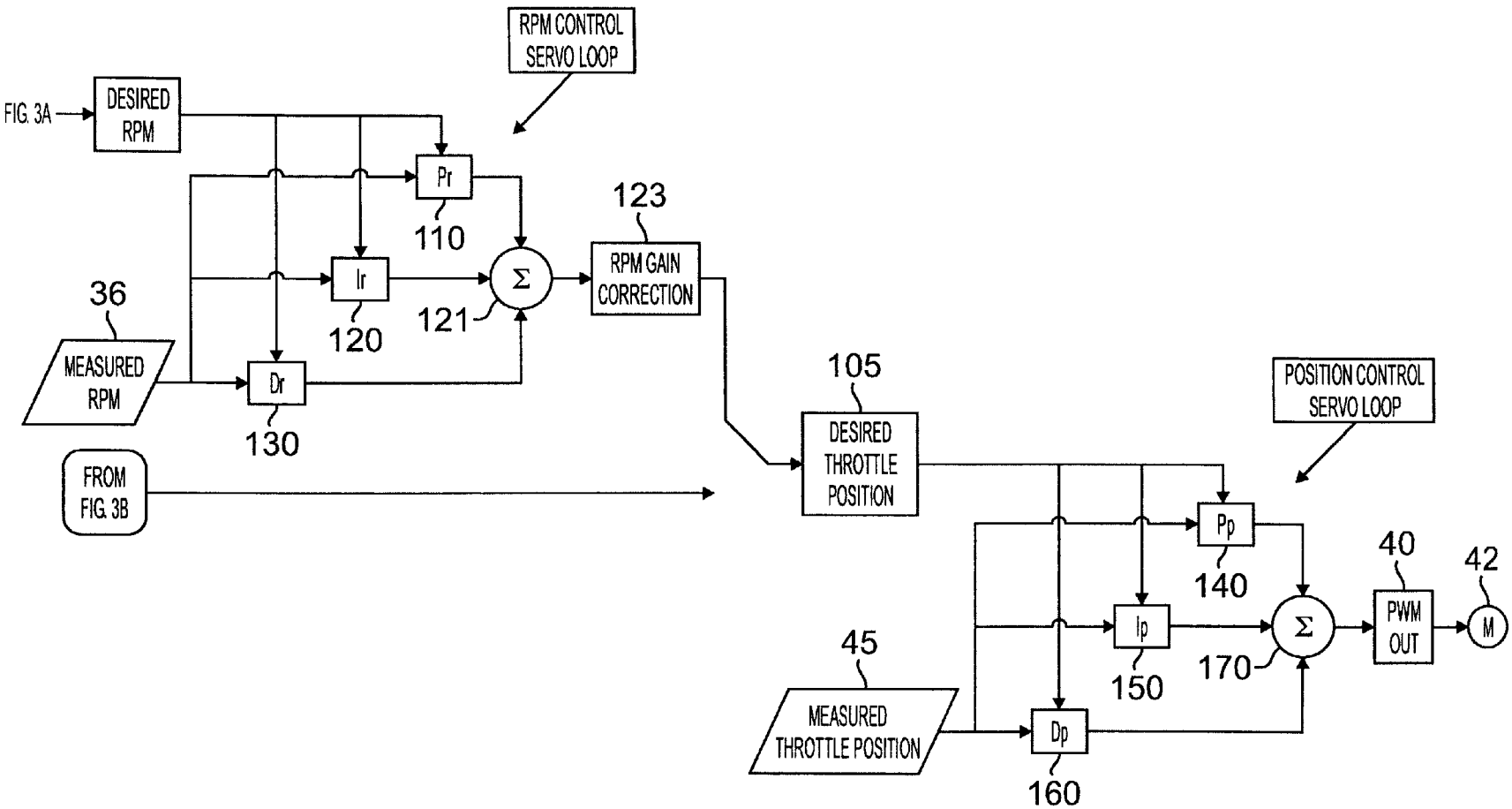

Referring to FIGS. 4A and 4B, a block diagram illustrates the operation of one of the servos in controller 32 which generates output signal 40 in response to first and second electrical signals 34, 45. In general, the servomechanism uses a PID (Proportional, Integral, Derivative) control algorithm for controlling the speed of motor 5 in response to inputs from the operator and a number of sensors. Further details for understanding the operation of PID servomechanisms and controllers can be found in "PID Controllers: Theory, Design, and Tuning" by K. Aström and T. Haggl üind, Instrument Society of America, 1995. In the simplest form of operation, the inputs represent the desired motor position (e.g., a desired position of output arm 44 as a function of throttle lever 10) and the actual measured position of output arm 44 at throttle 7, respectively.

In operation, the operator controls the throttle by setting the position of throttle lever 10. As the operator moves throttle lever 10, position sensor 30 detects its position of lever 5 while position sensor 48 detects the position of output arm 44 and generates a second control input. In response to the first and second control inputs, controller 32 generates a throttle control output to adjust the position of output arm 44 and apply a force to throttle 7, thereby controlling the speed of the boat.

As shown in FIGS. 4A and 4B, electrical signals 34, 45 are used to compute portions P, I, and D of the PID control signal to generate signals 140, 150, and 160. These computations are outlined below, however there are many different equations that will provide satisfactory results.

The P portion of the signal is computed by comparing the desired throttle position 105 to the measured throttle position 45. The equation follows:

Pp=Kp(Bp(DesiredThrottlePosition105)−(MeasuredThrottlePosition45))

Where Kp is a scalar parameter used to tune the gain of the servo loop and Bp is a parameter that allows reducing the sensitivity of the servo loop to changes in the Desired Throttle Position 105.

The I portion of the signal is created from the same dynamic inputs, using the integral of the signal to generate its control contribution 150. The equation follows:

$$Ip = \int Kp \frac{(DesiredThrottlePosition105) - (MeasuredThrottlePosition45)}{Ti_p}$$

Where Tip is a tuning parameter allowing independent adjustment of the I signal 150.

The D portion of the signal is computed from the same inputs, using the first derivative of the measured throttle position to create the output. The equation follows:

$$D = Kp * Td_p \frac{d(Cp(DesiredThrottlePosition105) - MeasuredThrottlePosition45)}{dt}$$

Where Kp is the same scalar parameter and Tp is another tuning parameter, allowing independent adjustment of the D signal 160. Cp is a tuning parameter similar to Bp, above, that allows reducing the sensitivity of the servo loop to changes in the Desired Throttle Position.

The P signal 140, I signal 150, and D signal 160 are summed together to generate signal 170. This signal is then amplified to create signal 40 to drive the actuator motor 42.

The Position Control Servo Loop 180, described above illustrates the basic functionality of each of the three possible servo loops in the control system.

In another embodiment, an additional servo loop can be added as an option to provide increased control of the boat motor speed. Referring to FIGS. 4A and 4B, the RPM Control Servo Loop uses the very same calculation methods to generate a desired response 121, using Desired RPM and Measured RPM as the input values. An additional Gain Correction 122 step is added to linearize the response of the motor RPM control. This Gain correction represents a model of the motor response to throttle setting.

In practice, the gain correction works as follows. The Desired RPM Response 121 is multiplied by the slope of the curve of Measured RPM 36 vs. Throttle Position 45. This allows the RPM Control Servo Loop 190 to behave more predictably.

As stated earlier, the RPM Control Servo Loop 190 is cascaded with the Position Control Servo Loop 180 to allow tight control of the performance of each aspect of the speed control (e.g.,throttle movement and motor response). To further enhance the operation of the speed control, another sensor can be used to sense actual boat speed. This sensor can be any type that senses boat speed, including Pitot Tube, Paddle Wheel, Loran-C, or GPS.

The boat speed sensor can be monitored by a third cascaded servo loop, a Boat Speed Servo Loop 200, identical in operational design to the RPM Control Servo Loop 190. This loop will also have gain correction, however this gain correction will operate as follows. The Desired Boat Speed Response 221 is multiplied by the slope of the curve of Measured Boat Speed 236 vs. Measured RPM 36. This allows the Boat Speed Servo Loop 200 to behave more predictably.

Other embodiments are within the scope of the claims.

Additional servo loops can be added (e.g., as an option) as well with each servo loop, in essence, modifying the operation of the loop to which it is added. For example, the output from Pitot tube 28 can be used as an additional input in a similar servo loop and cascaded with the "Measured Speed (RPM)" input shown in FIG. 4. Moreover, a Global Positioning System (GPS) or paddle wheel can be used as a substitute for Pitot tube 28.

As stated above, the position of throttle lever 10 may represent the operator's desired motor speed. For example, the desired operator input can be in the form of an input device (e.g., keypad) that allows the desired speed to be entered and displayed on a screen along with the actual boat speed (measured for example with a GPS system). By simply touching or grabbing throttle lever 10, the operator can override this automated system.

In certain embodiments, speed control system 20 can be retrofitted with a standard boat control and can be selectively decoupled. In the standard boat control, lever 10 typically controls the throttle and also includes a shift mechanism. The throttle control and the shift mechanism are generally concentrically coupled and can operate cooperatively or independently. Speed control system 20 can also be interfaced, e.g., concentrically, to standard control 80 to be releasably coupled, e.g., using a pin or dog engagement, thereby providing a fail-safe feature, When the operator wants to override control system 10, the operator can, for example, engage pin, to resume standard control.

A major advantage of speed control system 20 is the elimination of the long push-pull cable which mechanically connects the throttle lever in the cockpit of the boat to the throttle of the boat's motor, typically at the rear of the boat. As the length of the push-pull cable generally increases with the length of the boat, the difficulty in transferring the movement at one end of the cable to the other end increases, due primarily to friction and backlash. In particular, friction is generated between the inner cable and outer protective casing during movement. Increasing the "slack" between the inner cable and casing to reduce friction, however, increases backlash. These mechanical problems are minimized using the speed control system described above by detecting the degree of movement at the throttle lever and transmitting a signal representative of that change in movement.

Furthermore, this concept of substituting a position sensor/actuator/controller approach for longer length cables is applicable in controlling the boat in other ways. For example, rather than connecting the system to a throttle cable, a similar system can be connected to the transmission cables (input and output) of the boat. For example, a position sensor can be appropriately positioned to detect the relative position of a transmission selector. That is, the position sensor detects whether the selector is in a "forward," "reverse," or neutral (idle) position, in a one-speed configuration.

Figure 5:
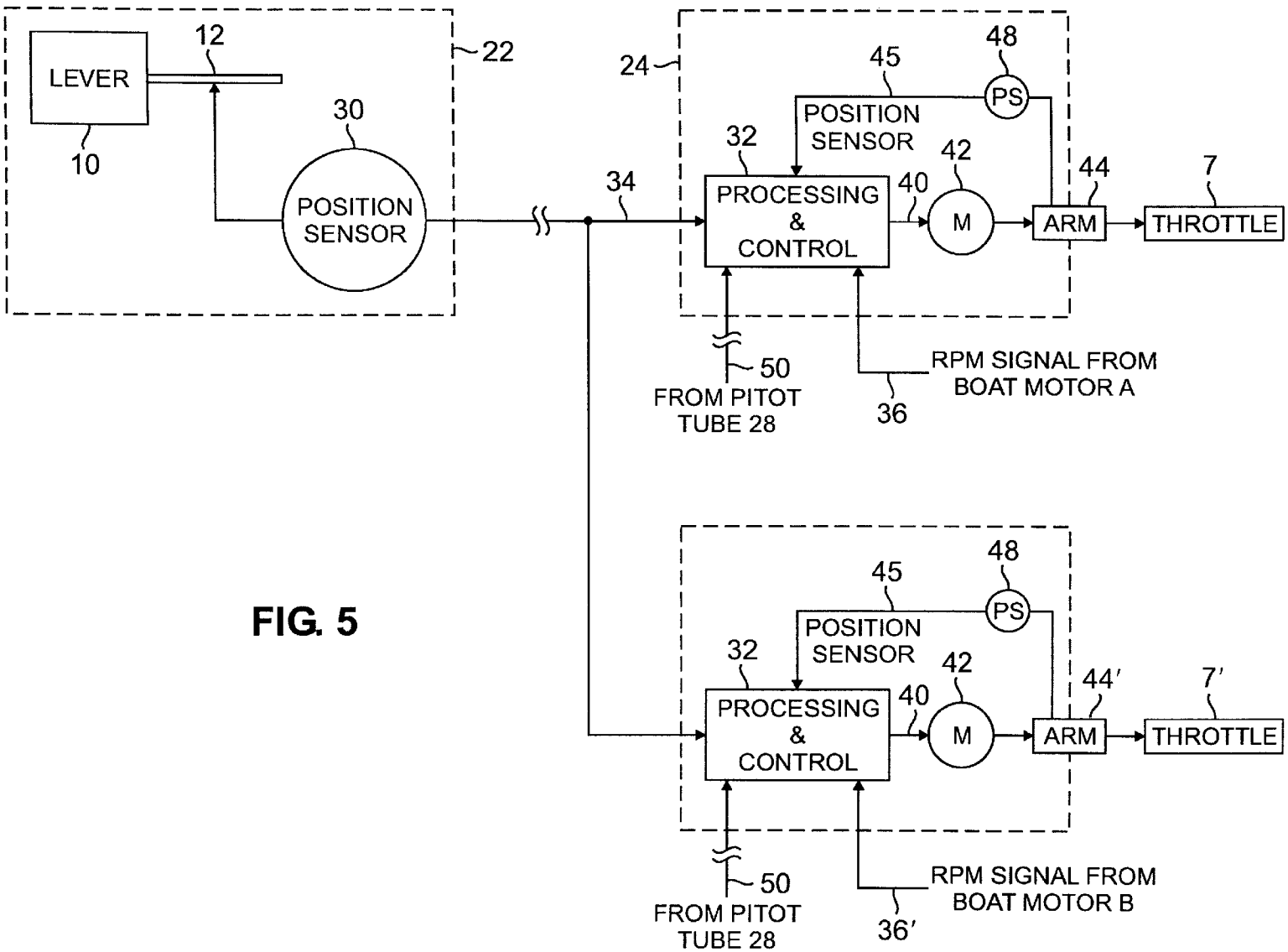
FIG. 5 is a schematic representation of a multiple engine implementation of the invention.

Referring to FIG. 5, although the boat speed control system was described for use in conjunction with a single engine or motor, it is equally applicable to multiple boat engine arrangements. For example, in one twin-engine configuration, two similar engines are used to propel the boat, typically with propellers configured to rotate in opposite directions. In this embodiment, it is important to control the engines so that they both run in a synchronized manner at substantially the same speed (RPM). Typically, this is accomplished manually by using two independent control levers adjusted or "tuned" by the sound of the engines. Alternatively, a device, called an "engine synchronizer" adjusts one of the engines (the slave) to match its speed with the speed of the other engine (the master). However, when using such engine synchronizers, there is a "lag" associated with the slave engine responding to a change in speed of the master. In a twin-engine configuration of this type, a boat speed control system can be used by reading the desired engine speed (RPM) from a single control sensor and then controlling a pair of actuators 44, 44', each connected to the respective throttles 7, 7' of the two engines. This approach for controlling the RPM automatically ensures that the engines respond in parallel without the problem of lag.

There is another multiple engine arrangement in which the speed control system is applicable. In this other arrangement, an auxiliary engine is used as a backup to a main engine or, for example, as a trolling engine. Typically, the auxiliary engine is operated independently from that of the main engine and requires manual operation (usually from the rear of the boat). Operation in this manner is inconvenient for larger boats. To facilitate operation, systems are available to mechanically tie together the two engines, for example, with a tie rod. Control is accomplished by going to the back of the boat to set the speed, and then running back to the cockpit to steer. Alternatively, a secondary control lever is required.

Once again, the speed control system described above can be used to control both engines using a single throttle lever position sensor and two output actuator systems. In one embodiment, separate servo controller mechanisms are associated with each actuator system with the signal from the throttle lever position sensor transmitted simultaneously to both servo controller mechanisms. Because only one engine is used at a time, the signal from the throttle lever position sensor controls only the engine currently in use. Referring again to FIG. 5, in this embodiment, the other actuator system would be powered off with the engine not in use. In certain embodiments, this twin-engine arrangement can be used with the transmission system control described above.

Although wires 34 were used in the embodiment described above, wireless systems (e.g., RF transmit/receive) may be substituted as well. In a wireless embodiment, circuitry for minimizing interference by radiating sources including other wireless boat control systems may be necessary. For example, the use of coding schemes can be used to ensure that transmissions by one user do not effect the operation of another receiving the transmissions.

Furthermore, the relative position of the various parts of speed control system may be electrically and mechanically connected in accordance with the particular application. In the embodiment above, speed control system included a first and second housings positioned at the cockpit and stem of the boat, respectively. In other embodiments, the entire speed control system can be assembled together in one housing or be separated into various components with or without housings. It is also appreciated that in boats with multiple helm stations, each boat control system may be connected to more than one throttle lever and selectively activated.

Still other embodiments are within the following claims.

What is claimed is:

1. A speed control system comprising:

a first servo control loop to control the speed of a boat, the first servo control loop having a plurality of input signals and an output signal;

a second servo control loop to control the speed of the motor, the second servo control loop having a plurality of input signals, one of which is the output signal from the first servo control loop.

2. The control system of claim 1 further comprising a third servo control loop to control the position of an actuator coupled to a throttle of the motor.

3. The speed control system of claim 1 wherein the first servo control loop processes the input signals digitally to generate the output signal.

* * * * *